United States Patent [19]

Smith et al.

[11] 3,986,672

[45] Oct. 19, 1976

[54] SPRAY GUN SYSTEM

[76] Inventors: Robert L. Smith; Gary L. Smith, both of 435 Fair Drive, Apt. No. 103, Costa Mesa, Calif. 92626

[22] Filed: Jan. 31, 1975

[21] Appl. No.: 546,004

[52] U.S. Cl. ..... 239/394; 239/411; 239/433; 251/321

[51] Int. Cl.[2] ..... B05B 7/14

[58] Field of Search ..... 239/433, 428, 420, 527, 239/528, 394, 391, 392, 410, 411, 412, 413, 414; 251/321

[56] References Cited

UNITED STATES PATENTS

| | | | |
|---|---|---|---|
| 2,370,408 | 2/1945 | MacDonald | 239/528 X |
| 3,057,273 | 10/1962 | Wilson | 239/412 X |
| 3,111,272 | 11/1963 | Underdown et al. | 239/420 |
| 3,458,137 | 7/1969 | Behr | 239/414 |
| 3,788,555 | 1/1974 | Harrison et al. | 239/420 X |
| 3,801,009 | 4/1974 | Marshall | 239/433 X |

*Primary Examiner*—John J. Love
*Assistant Examiner*—Michael Mar
*Attorney, Agent, or Firm*—Lindenberg, Freilich, Wasserman, Rosen & Fernandez

[57] ABSTRACT

A gun for spraying resin and catalyst and for holding an air-powered chopper that chops and deploys fiberglass, wherein the gun has an air-powered spray release valve, and has an air control valve operated by a single trigger to separately control the flow of air to the spray release valve and to the chopper. A nozzle plate at the front end of the spray gun has a convex rearward surface with two holes for receiving nozzle inserts, the holes being formed perpendicular to the convex surface so the sprays from the two nozzles cross a short distance in front of the gun.

10 Claims, 7 Drawing Figures

SPRAY GUN SYSTEM

BACKGROUND OF THE INVENTION

This invention relates to spray gun systems and to an air valve useful therewith.

One type of spray gun system employs a gun that sprays resin and catalyst at a workpiece and an air-operated chopper for chopping fiberglass and projecting it onto the workpiece. The spray gun typically utilizes a mechanical linkage between a trigger and each of two valve opening members to draw back the valve members and allow pressured resin and catalyst to be sprayed from the gun. An air hose typically extends to the chopper, and an air valve near the chopper must be opened to begin the chopping and deployment of fiberglass or other wire material. A workman typically pulls the trigger with his right hand to begin spraying resin and catalyst, and a short while later opens the air valve to the chopper with his other hand to begin spraying fibers at the workpiece. The operation is often cumbersome because of the need for utilizing both hands to begin spraying, the need for continually applying large forces to the trigger to overcome a spring that will return the valve members to a closed position, and the need to use the left hand to close the chopper valve at the end of spraying. Two separate valve assemblies are typically used to spray the resin and fiberglass, with the two assemblies angled towards each other so that the two sprays cross and merge a short distance in front of the gun. The use of two separate valve assemblies, each with its own linkage and material-holding tube, increases the complexity and size of the spray gun.

SUMMARY OF THE INVENTION

In accordance with one embodiment of the present invention, a spray gun system is provided which is of relatively simple and compact construction and which can be easily operated. The system includes a spray gun for spraying resin and catalyst, and an air-powered chopper for chopping and deploying fiberglass or the like. The spray gun includes an air-energized piston with a pair of valve members fixed thereto, which can be drawn back to open the resin and catalyst valves upon the application of air pressure to the piston. The gun also includes a trigger operated air valve which controls the flow of air to both the air piston and to the chopper. When the trigger is pulled back a small amount, air is delivered only to the air piston, to begin spraying resin and catalyst, and when the trigger is pulled back further air is supplied to the chopper to also begin the spraying of fibers. A workman operating a single trigger can therefore control the start of resin and catalyst spraying, and can separately control the beginning of air chopper operation.

Resin and catalyst are carried through two laterally spaced tubes that lead to a valve plate at the front of the gun. The valve plate has a pair of passages that couple the tube to closely-spaced valve seats that lead to forwardly-opening nozzle holes, the valve seats being opened and closed by the two valve members on the air piston. A nozzle plate mounted in front of the valve plate, has a pair of insert holes that receive nozzle inserts to control the shape of the resin and catalyst sprays. The rear surface of the nozzle plate is convex, while the forward surface of the valve plate is concave. The insert holes are formed perpendicular to the convex surface of the nozzle plate so that the sprays intersect and merge a small distance in front of the gun.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
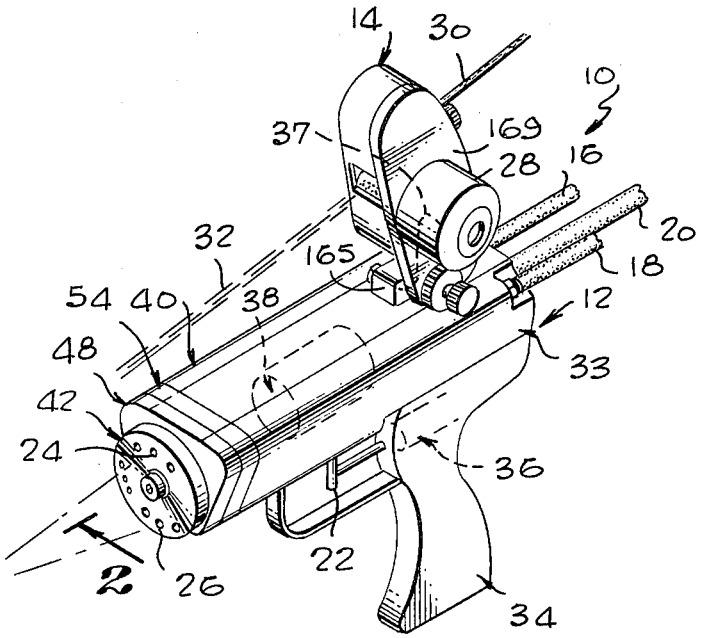
FIG. 1 is a perspective view of a spray gun apparatus constructed in accordance with the present invention.

FIG. 1 illustrates a spray gun apparatus 10 which includes a spray gun 12 and a chopper 14 mounted on top of the spray gun. The gun 12 receives resin and catalyst from two material hoses 16, 18, and receives air from an air hose 20. When a workman pulls on a trigger 22, he causes material valves in the gun to open so that resin and catalyst are sprayed out of two nozzles 24, 26 towards a workpiece, and he also causes operation of an air motor 28 on the chopper so that the chopper pulls in wires 30 of fiberglass and deploys or sprays out chopped wire or fibers 32 at the workpiece. The spray gun has a frame 33 which includes a body 40 and a handle 34 at the rear end of the body. A workman normally grasps the handle 34 to hold the gun, and places his index finger on the trigger 22 to operate an air control valve 36 located at the upper portion of the handle. When the trigger 22 is pulled back a moderate amount, the valve 36 allows air to flow to an air cylinder 38 in the body 40 of the gun to open material valves and permit the spraying of the resin and catalyst materials. When the workman pulls the trigger 22 back further, he causes the air valve 36 to also supply air to the chopper 14 so that fibers are sprayed at the workpiece. Air to the chopper flow through a chopper-input passage 37 that leads to the air motor.

Figure 2:
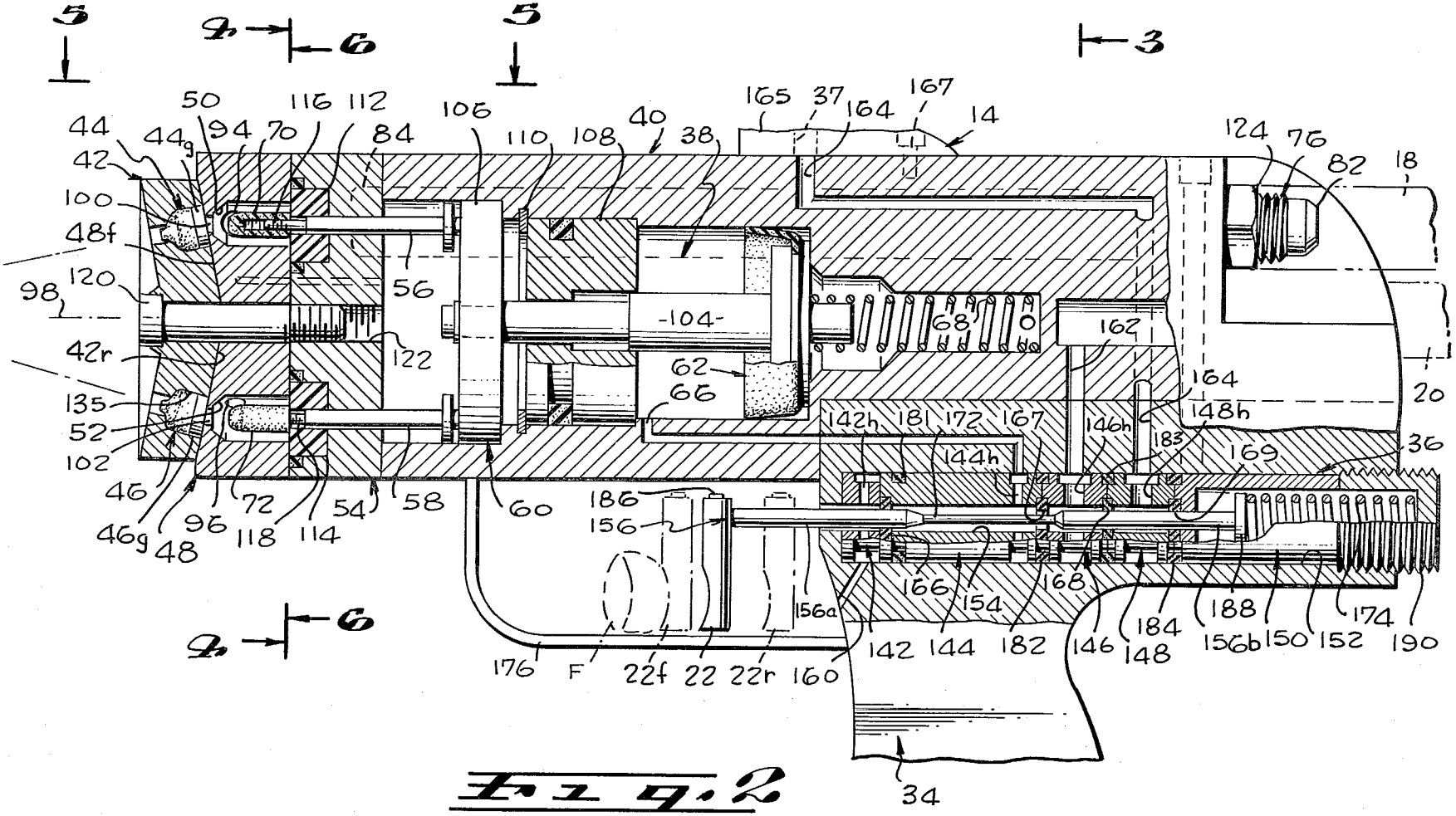
FIG. 2 is a sectional side view of the spray gun taken on the line 2—2 of FIG. 1.
Figure 3:
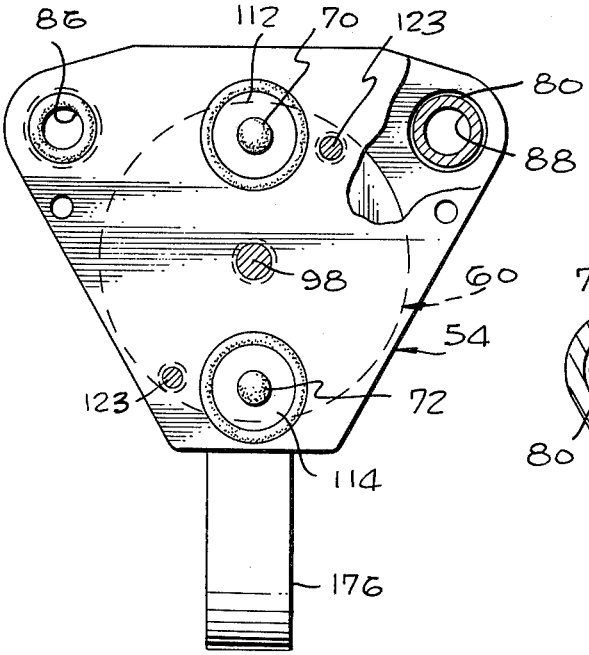
FIG. 3 is a view taken on the line 3—3 of FIG. 2.
Figure 4:
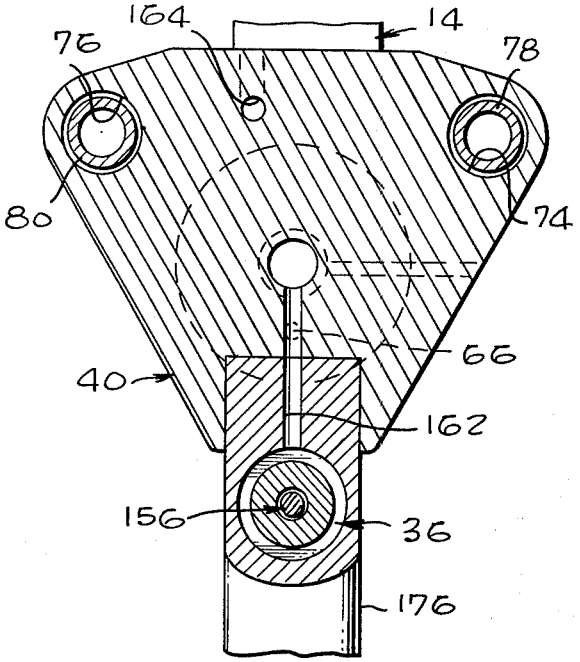
FIG. 4 is a view taken on the line 4—4 of FIG. 2.
Figure 5:
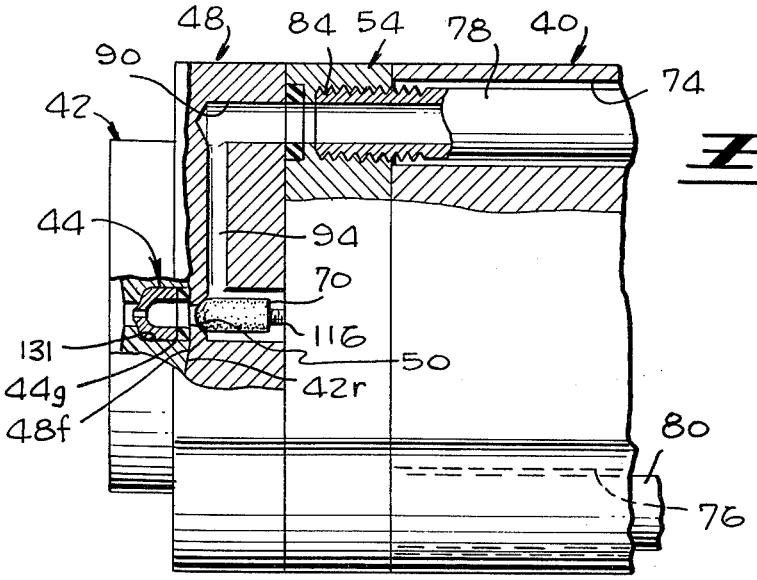
FIG. 5 is a view taken on the line 5—5 of FIG. 2.

As illustrated in FIG. 2, the front of the gun includes a nozzle plate 42 containing a pair of nozzle inserts 44, 46 which control the spray pattern, a valve plate 48 positioned behind the nozzle plate and forming a pair of valve seats 50, 52 across which the resin and catalysts material must flow to reach the nozzles, and a guide plate 54 positioned between the valve plate 48 and gun body 40 of the gun frame to guide a pair of valve closing members 56, 58 that can move against and away from the valve seats 50, 52 to control the flow of material. The valve closing members 56, 58 ar part of an air piston 60 which has an air-driven portion 62 mounted in the air cylinder 38 which is formed as a bore in the gun body. When pressured air is delivered through an air cylinder passage 66 to the cylinder 38, the piston portion 62 is urged rearwardly against the force of a piston return spring 68, to move the piston and the valve closing members 56, 58 thereof rearwardly. As a result, valve tips 70, 72 at the front ends of the valve closing members are drawn back, away from the valve seats 50, 52, to allow resin and catalyst fluids to be sprayed through the nozzles 40, 46 at the workpiece. When air in the cylinder bore or cylinder 38 is exhausted therefrom, the return spring 68 moves the piston and the valve tips 70, 72 thereof against the valve seats 50, 52 to stop the spraying of fluid.

Figure 7:
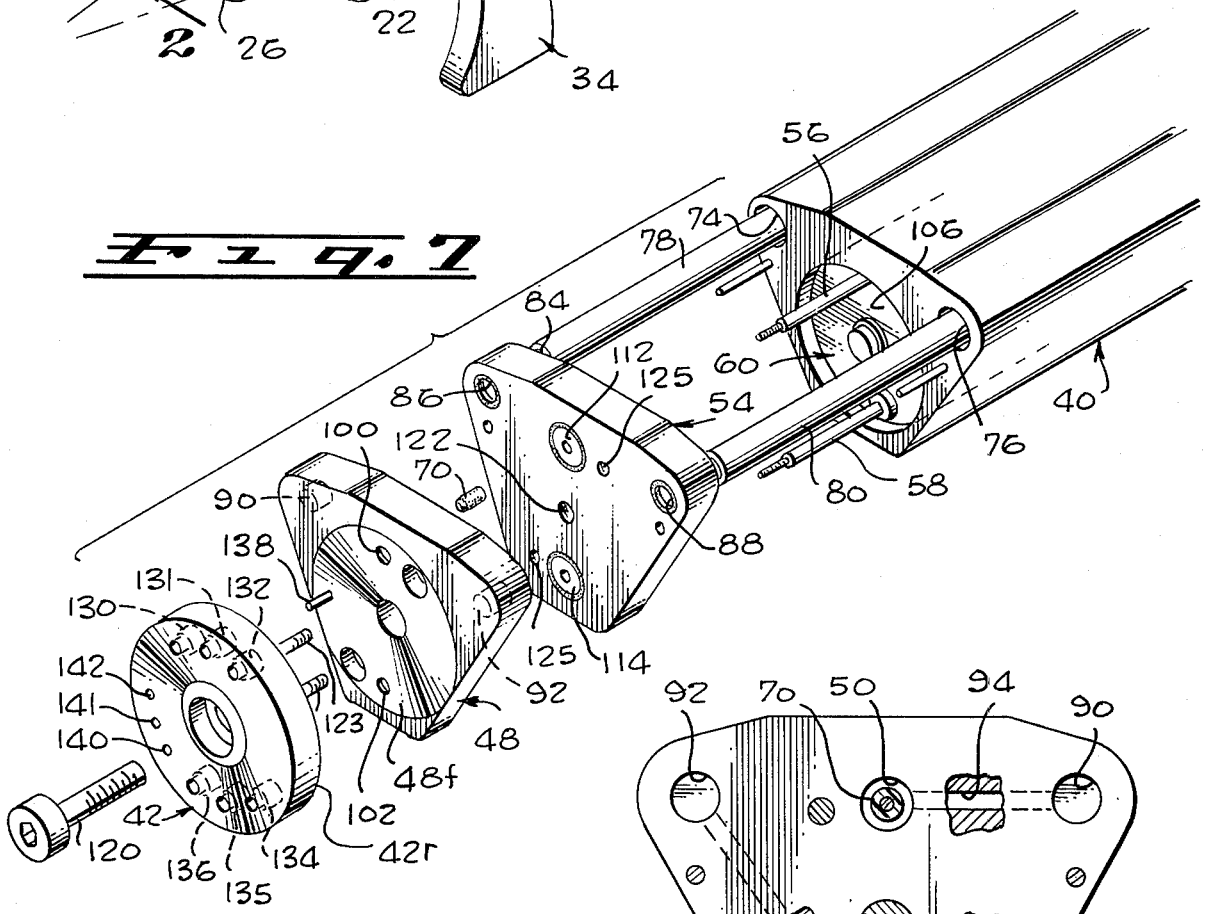
FIG. 7 is an exploded perspective view of the front portion of spray gun of FIG. 2.
Figure 6:
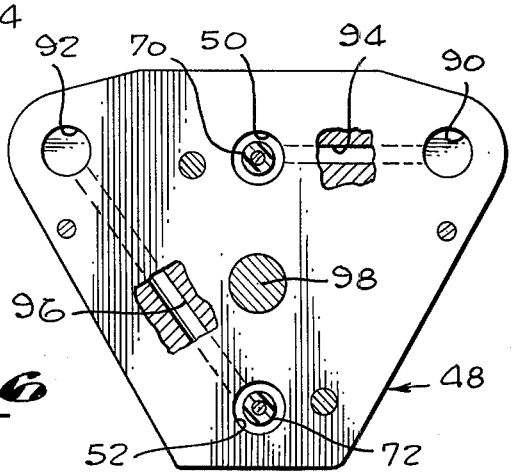
FIG. 6 is a view taken on the line 6—6 of FIG. 2.

The valve body 40 is a largely triangular-shaped member with a pair of widely-spaced fluid bores or tubes 74, 76 (FIG. 7) extending longitudinally therealong. A pair of separate material tubes 78, 80 extend through each of the bores 74, 76 in the gun body to carry the resin and catalyst to the front portion of the gun. Each material tube such as 78 has a rearward end 82 (FIG. 2) exposed at the rear of the gun for connecting to a fitting on a corresponding material hose 16, and has a front end 84 forming a pipe (tapered) thread which is screwed into the guide plate 54. The guide plate has a pair of holes 86, 88 that carry the fluid from the tubes forwardly to aligned holes 90, 92 in the valve plate 48. The valve plate 48 (FIG. 6) has a pair of material passages 94, 96 which extend laterally, or in other words perpendicular to the longitudinal axis 98 of the gun to couple the material-carrying tubes to the valve seats 50, 52. The valve plate forms nozzle holes 100, 102 in front of the valve seats through which material passes towards the nozzle inserts 44, 46, the material from the nozzle inserts being sprayed from the gun.

The air piston 60 (FIG. 2) includes a central rod 104 with a rearward end which carries the piston portion 62. Pressured air presses rearwardly against the piston portion and the piston return spring 68 presses forwardly against it. The rod 104 also has a forward end with a plate 106 upon which the two valve closing members 56, 58 are mounted. The rod 104 extends through a retainer block 108 which is held in the cylinder bore 64 of the gun body by a retainer ring 110. The front portions of the valve closing members 56, 58 are guided in longitudinal sliding motion by a pair of guides 112, 114 of a low friction plastic such as acetyl plastic, to direct the valve tips 70, 72 accurately against the valve seats 50, 52. The valve closing members 56, 58 include rods with threaded forward ends 116, 118, and the tips 70, 72 threadably fit onto the threaded ends. The tips 70, 72 are constructed of a cold flowable material such as Teflon, while the valve plate 48 and the valve seats 50, 52 thereof are formed of aluminum. The soft cold flowable material of the tips conform to the exact shape of the valve seats, to provide good sealing thereat which minimizes or or prevents dripping of material from the nozzles when material is not being sprayed. The Teflon tips can wear faster than tips of hard material such as tungsten carbide, but they can be easily replaced, and the fact that they do not have to be precision ground reduces the cost of the gun.

Replacement of the valve tips 70, 72 is accomplished by removing a front bolt 120 which extends through a central hole in the nozzle plate 42 and valve plate 48 and which is threaded into a central hole 122 in the guide plate. A pair of additional bolts 123 which pass through holes in the valve plate and which are threaded into holes 125 of the guide plate 54 then are removed. The nozzle plate and valve plate then can be removed to expose the tips 70, 72, and the tips can be screwed off and new tips installed at the ends of the valve closing members 56, 58. The guide plate 54 is securely held to the valve body 40 by the two material tubes 78, 80 whose front ends are screwed into the guide plate and whose rearward ends are held in place by a pair of nuts 124.

The nozzle plate has a rear surface **42*r* which is convex and which is beveled, or in other words, part of the surface of a cone. The valve plate has a mating concave forward surface 48*f*. The convex rear surface of the nozzle plate has a pair of insert holes 131, 135 for receiving the nozzle inserts 44, 46, and has a pair of gaskets 44*g*, 46*g* of a cold-flowable material such as Teflon behind the nozzle inserts for sealing the area around the nozzle apertures to the front surface of the valve plate 48, to prevent the leakage of material to be sprayed. The insert holes 131, 135 are formed perpendicular or normal to the convex surface 42*r* of the nozzle plate, so that the resin and catalyst sprays intersect and mix in the air at a short distance, such as three inches, in front of the gun. The amount of convexity of nozzle rear surface 42*r* is chosen so that nozzles perpendicular to the convex surface will intersect at the desired location in front of the gun; e.g. for a conical surface 42*r* angled at 10° from the lateral direction, and for nozzle inserts spaced 1 inch apart, the sprays will intersect about three inches forward of the convey surface. A convex surface which is part of a spere can be used, and it would allow gasket sealing with less gasket deformation or cold flow, but such a surface is generally more difficult to machine. A convex surface formed by two intersecting planes could be used, but it generally is no easier to produce and requires even more deformation of the gasket. The inserts 44, 46 can be placed in the corresponding insert holes 131, 135, gaskets 44*g*, 46*g* of uniform thickness can be placed behind the inserts, and the nozzle plate can be fastened against the valve plate to form a leakproof passage between the nozzle holes 100, 102 leading forwardly from the valve seats 50, 52 and the nozzles of the nozzle inserts. Thus, the two valve closing members 56, 58 can extend and move parallel to one another, to enable mounting on the same piston, and yet the nozzle inserts 44, 46 can be angled towards one another, all without a relatively simple sealing arrangement to prevent leaking of the resin and catalyst. It may be noted that the upper nozzle insert which sprays resin, may have an opening of about thirty thousandths inch while the lower nozzle insert 46, which sprays catalyst, may have an opening of about nine thousandths inch. Also, resin in hose 16 may be maintained at a pressure of about twelve hundred psi, while catalyst in hose 18** may be maintained at a pressure of about 40 psi, so much more resin is sprayed than catalyst.

In order to facilitate adjustment of the spray patterns emanating from the spray nozzles, the nozzle plate 42 is constructed to hold three pairs of nozzle inserts. The nozzle plate has three recesses 130–132 near the top of its convex rear surface and three recesses 134–136 near the bottom thereof, each of which can hold a replaceable nozzle insert similar to inserts 44 and 46. A workman can change from one set of nozzle inserts such as 44, 46 in recesses 131, 135 to another set of nozzle inserts in another pair of recesses such as 130, 134 by merely turning the nozzle plate 42 by a few degrees to align the new set of recesses and nozzle inserts therein with the nozzle holes 100, 102 in the valve plate. In order to assure precise alignment of each nozzle insert with the corresponding nozzle holes 100, 102, the valve plate 48 is provided with an alignment pin 138 and the nozzle plate is provided with three alignment holes 140–142 which can receive the pin. In order to change the nozzles, a workman merely unscrews the central bolt 120 far enough to permit turning of the nozzle plate 42, then pushes the nozzle plate rearwardly so that the pin 138 enters a new alignment hole, and then tightens the bolt 120.

The air control valve 36 (FIG. 2) at the top of the handle 34 can be constructed economically and yet permits a workman to control both liquid (resin and catalyst) spraying and fiber spraying in a simple manner. The valve includes five ring or cylinder members 142, 144, 146, 148 and 150, which are all received in a bore 152 formed in the gun handle. The ring members form a valve chamber or bore 154, and a valve rod 156 projects through the ring member, or in other words, lies in the valve chamber 154. Each of the four forward ring members 142–148 have a radial hole 142*h*, 144*h*, 146*h*, 148*h*, for carrying air between the valve chamber 154 and a different one of four passageways. Thuss, the hole 142*h* in the forward exhaust ring 142 communicates with an exhaust passage 160 which exhausts air into the ambient atmosphere. The hole 144*h* in the air cylinder ring member 144 is in communication with the air cylinder passage 66 that carries air to and from the air cylinder bore 38. The hole 146*h* in the air input ring member 146 is in communication with a passage 162 that is connected to the air hose 20 that supplies pressured air to the spray gun apparatus. The hole 148*h* in the chopper supply ring member 148 communicates with a chopper supply passage 164 that supplies pressured air to the chopper 14. The chopper supply passage 164 communicates with the passage 37 in a chopper mount 165 of the chopper assembly, the mount 165 being fastened rigidly by a bolt 167 to the gun body 40 and the frame 169 of the chopper.

The air control valve 36 has several internal O-ring seals spaced along the length of the valve chamber 154, which can engage the outside of the valve rod 156 and form an air seal therewith. These include four internal O-rings 166–169. However, the rod has an elongated cutout, or reduced diameter portion, 172 which can lie within some of the O-rings to unseal them. The rod also has forward and rearward cylindrical seal portions 156*a*, 156*b* which are of slightly larger diameters than the O-rings to form seals with them.

The solid lines of FIG. 2 show the spray gun in a condition wherein air is supplied to the air cylinder 38 to draw back the piston and spray material from the gun, but wherein air has not yet been supplied to the chopper 14. At this position of the valve rod 156, the cutout portion 172 of the rod has moved back sufficiently so that it lies within the O-ring 167. As a result, pressured air supplied through the passage 162 and passing through the hole 146h of the air input ring member 146, passes by the O-ring 167. This air then passes out through the hole 144h of the air cylinder ring member and through the passage 66 to the air cylinder 38 to pressurize it and move back the air piston 60.

If the trigger 22 is pulled back to an extreme rearward position at 22r, the rod cutout 172 will also lie within the O-ring 168. This will allow pressured air passing into the valve chamber through the holes 146*h* of the air input ring member, to move rearwardly past the O-ring 168 and out through the hole 148*h* of the chopper supply ring member, and thence through passage 164 which leads to the chopper 14. Thus, when the workman pulls the trigger back all the way he causes both the liquid (resin and catalyst) and the fibers to be sprayed at the workpiece.

When the workman releases the trigger, a spring 174 moves the valve rod 156 forwardly until the trigger is at a forwaard position at 22*f*. The cutout portion 172 of the rod then lies only within the forward O-ring 166. At that position of the cutout, pressured air in the cylinder 38 can exhaust through the passage 66, through hole 144*h* of the air cylinder ring member, past the O-ring 166, out through hole 142*h* of the exhaust ring member, and through exhaust passage 160 to the ambient atmosphere. (If desired, separate holes, each coupled to passage 66 or separate passages leading to the air cylinder, can be provided instead of only hole 144*h*, one to exhaust the air cylinder and one to carry pressured air to it.) This permits the rapid escape of air from the air cylinder so that the air piston 60 can move forwardly to stop the spraying of fluid. At the forward position of the valve rod 156, the rod portion behind the cutout 172 forms a seal with the O-rings 167, 168 to prevent the flow of pressured air from the air supply hose to either the air cylinder or the chopper.

A workman can grasp the handle 34 of the gun, place his finger F through the trigger guard 176 and against the trigger to control both fluid spraying and chopper operation. When the workman pulls back the trigger from the initial position at 22*f* to a first position rearward thereof at 22, he causes the initial spraying of the resin and catalyst fluids but does not operate the chopper. When he pulls back the trigger further to the position 22*r*, he begins operation of the chopper to spray fibers at a workpiece. The gun is normally operated by initially spraying only resin and catalyst, and thereafter spraying fibers as well as the resin and catalyst. It is seldom necessary to operate the chopper without spraying fluid, although this could be done by merely shutting off pressurizing air to the resin and catalyst tanks (not shown).

The several ring members 142–150 could be replaced by a single member, except that the use of several ring members facilitate the installation and replacement of O-rings, particularly the four internal O-rings 166–169 that seal to the major diameter portions of the valve rod 156. Thus, the forward O-ring 166 lies in a groove formed at the front of the air cylinder ring member 144, while the next internal O-ring 167 lies in grooves formed at abutting ends of the ring members 144 and 146. The third O-ring 168 lies in grooves formed at abutting ends of the ring members 146, 148, while the rearward O-ring 169 lies in grooves of the ring members 148, 150. The rearward O-ring 169 serves merely to prevent the escape of air rearwardly around the valve rod. In addition to the small O-rings, additional O-rings are provided at the outside of the ring members to prevent the flow of air around the ring members, these being the large valve O-rings 181–184. It may be noted that the trigger 22 is held to the front end of the valve rod 156 by a set screw 186, the rear end of the valve rod has a flange 188 which receives force from the spring 174 and which limits forward movement of the valve rod, and all of the ring members and spring are held in place by an end cap 190.

Thus, the invention provides a spray gun apparatus which permits relatively simple operation and adjustment. The gun includes an air-operated spray control device including an air cylinder, and also includes a valve operated by a single trigger for controlling the flow of air to the air cylinder and to a chopper mounted on the gun. The air control valve includes a rod which slides along a valve chamber and which has a cutout which moves progressively along the chamber to couple the air cylinder to an exhaust passage or pressured air source, and to couple the pressured air source to the chopper while also coupling the air source to the air cylinder. The material to be sprayed passes through two widely spaced tubes that extend to a valve plate near the front of the gun, the valve plate having lateral passageways extending to two more-closely spaced valve seats. A pair of valve closing rods or members extending from an air piston to move against and away from the valve seats. A nozzle plate at the front of the gun can be turned to a plurality of different precise positions to enable a workman to choose any of a plurality of sets of nozzles, by merely loosening a screw and retightening it. The entire spray gun assembly is not only easily operated, but it encloses most of the operating parts within a relatively smooth body and provides for attachment of the chopper without flexible hoses leading thereto, to provide a neat appearance and to help maintain all parts of the gun in a clean condition.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. Spray gun apparatus comprising:

a spray gun having a frame with front and rearward portions, a nozzle at said front portion, a valve seat behind said nozzle, an air cylinder, an air piston with an air-driven portion disposed in said cylinder and sealed to the cylinder wall, a valve closing member coupled to said piston to move against and away from said valve seat in response to the charging and discharging of said cylinder with compressed air, an air inlet for receiving compressed air, an air passage extending between said air inlet and said cylinder, and a manually controllable valve disposed along said passage; and an air-energized chopper assembly disposed on said gun;

said spray gun including a chopper air supply passage extending from said valve to the location of said chopper assembly to supply pressured air thereto;

said valve including means defining an elongated chamber with an air input aperture, an exhaust aperture, a cylincer aperture, and a chopper aperture, all spaced along said chamber, said input aperture coupled to said air inlet to receive pressured air therefrom, said exhaust aperture coupled to the ambient atmosphere, said cylinder aperture coupled to a location at said air cylinder in front of said air-driven piston portion, and said chopper aperture coupled to said chopper air supply passage;

said valve including a rod slidably mounted in sid chamber and sealed to the walls thereof but having a cutout to selectively couple said apertures, said rod being slidable from an initial position wherein said rod couples said exhaust aperture to said cylinder aperture while sealing the other of said apertures from one another, to a first position wherein said rod couples said air input aperture to said cylinder aperture while sealing said exhaust apertue from said cylinder aperture, to a second position wherein said rod couples said air input aperture to both said cylinder aperture and said chopper aperture while sealing said exhaust aperture from said cylinder aperture, said valve including spring means urging said rod towards said initial position;

said valve also including manually movable trigger means connected to rod to move it.

2. The apparatus described in claim 1 wherein:

said spray gun frame has a valve bore;

said valve means includes a plurality of ring members disposed within and spaced along said valve bore, including an air input ring member, a chopper supply ring member positioned on one side of said air input ring member, and a cylinder feeder ring member disposed on a side of said air input ring member opposite said cylinder feeder ring member, each of said ring members having a radial hole therein and the holes in said input, chopper, and cylinder ring members respectively forming said air input, chopper, and cylinder input apertures;

said valve means includes a first O-ring between said input and cylinder ring members and a second O-ring between said input and cylinder ring members, both of said O-rings being of smaller internal diameter than the bores in the input, chopper, and cylinder ring members; and said rod includes a cylindrical seal portion of a diameter slightly greater than the internal diameter of said O-rings, and extending between said O-rings when said rod is in said initial position, and said rod having a smaller diameter cutout portion lying beyond said first O-ring when said rod is in said initial position, so that when said rod moves to said first position said cutout portion lies within said first O-ring to allow air flow from the input to the cylinder apertures to permit spraying of material and when said rod moves to said second position said cutout portion lies within both of said O-rings to allow air flow to said chopper aperture as well as said cylinder aperture.

3. The apparatus described in claim 1 wherein:

said chopper assembly includes a chopper frame, an air motor mounted on said chopper frame, a rigid mount member rigidly fixed to said chopper frame and to said frame of said spray gun at a predetermined location on said spray gun frame to hold said chopper frame to said spray gun frame; and said chopper air supply passage is formed in said spray gun frame and has an end at said predetermined location where said mount member is fixed, said mount member has a passageway formed therein which communicates with said end of said chopper air supply passage, and said chopper frame includes a passage portion coupling said passageway in said mount member to said air motor.

4. The apparatus described in claim 1 wherein:

said spray gun frame includes a handle adapted to be grasped by the hand and with the index finger at an upper portion of the handle, said valve chamber is mounted at the upper portion of said handle, said rod projects forwardly from the front of the upper portion of said handle, and said trigger means is attached to the front of said rod.

5. A spray gun comprising:

a gun portion with front and rear ends, a pair of laterally spaced nozzle holes at said front end, a pair of valve seats coupled to said nozzle holes to supply material to be sprayed thereto, a pair of material tubes coupled to said valve seats to supply material to be sprayed thereto, and a pair of valve closing members movable against and away from said valve seats to close and open them to the flow of material thereby;

a nozzle plate mounted at the front of said gun portion, said nozzle plate having a pair of laterally spaced insert holes for holding a pair of nozzle inserts, said nozzle plate having a rear surface and the rear ends of said insert holes are laterally spaced by the same distance as said nozzle holes so that said insert holes and nozzle holes can be aligned;

said rear surface of said nozzle plate being convex, said insert holes being formed perpendicular to said rear surface so that the sprays from nozzle inserts therein will intersect in front of the gun, and the front surface of said gun portion at the front ends of said nozzle holes is concavely formed to mate with said rear surface of said nozzle plate.

6. The spray gun described in claim 5 including:

a fastener extending through the center of said nozzle plate to fasten it to the rest of said gun, said nozzle plate having a plurality of pairs of insert holes with the two insert holes of each pair being spaced apart by the same distance and angled about the center of the nozzle plate, so that a different pair of insert holes can be aligned with the nozzle holes by turning the nozzle plate about said fastener, said nozzle plate and gun portion having alignment means for positioning said nozzle plate at positions wherein each nozzle hole is aligned with an insert hole.

7. The spray gun described in claim 5 wherein:

said gun portion includes a valve plate mounted at the front thereof and forming said valve seats and nozzle holes, and a pair of material tubes for carrying material to be sprayed, said valve plate having a pair of laterally-extending passages each with one end coupled to one to said material tubes and the other end coupled to one of said valve seats, said gun portion also including a reciprocately-mounted piston with a pair of valve closing members in line with said valve seats to move against and away from said valve seats.

8. A fluid control valve comprising:

means defining a valve body with an elongated chamber having forward and rearward ends, said body having first, second and third passages with ends intersecting said chamber and spaced along the length of the chamber, said second passage end spaced rearwardly of said first passage end, and said third passage end spaced rearwardly of said second passage end;

a plurality of seals, including a first seal positioned between said first and second passage ends and a second seal positioned between said second and third passage ends;

a valve rod slideably mounted in said elongated chamber, said rod having an elongated cutout portion and having a sealing portion rearward of said cutout portion, and said cutout portion being positioned so that said rod can lie in an initial position wherein said cutout lines formed of said first seal and said rearward sealing portion is sealed to said first and second seals, so that said rod can slide rearwardly to a first position wherein said rear part of said cutout portion lies within said first seal so that said first and second passages are coupled, and so to that said rod can slide further rearwardly to a second position wherein said cutout portion lies within both said first and second seals to couple said first, second and third passages.

9. The valve described in claim 8 wherein:

said means defining a valve body includes a frame with a valve bore and a plurality of ring members disposed within and spaced along said valve bore, including a middle ring member, a forward ring member positioned on one side of said middle ring member, and a rearward ring member disposed on the other side of said middle ring member, each of said ring members having a radial hole therein forming an end of one of said passages; and said first seal comprises a first O-ring between said forward and middle ring members and said second seal comprises an O-ring between said middle and rearward ring members, the internal diameter of both of said O-rings being smaller than the sealing portion of said rod.

10. The valve described in claim 8 wherein:

said valve body includes a fourth passage with an end intersecting said chamber forward of said first passage end;

said seals includes a third seal positioned between said fourth and third passage ends;

said valve rod has a forward sealing portion lying in front of said cutout end of a size to form a seal with said third seal; and said rod is formed so that in said initial position the front end of said cutout lies within said fourth seal to couple said fourth and first passages, while in said first position the forward seal portion of the rod lies within said seal to uncouple said fourth and first passages.

* * * * *